US008602755B2

(12) United States Patent
Park et al.

(10) Patent No.: US 8,602,755 B2
(45) Date of Patent: Dec. 10, 2013

(54) ROTARY COMPRESSOR WITH IMPROVED SUCTION PORTION LOCATION

(75) Inventors: Joonhong Park, Seoul (KR); Yunhi Lee, Seoul (KR); Yoonsung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 12/963,814

(22) Filed: Dec. 9, 2010

(65) Prior Publication Data

US 2011/0142705 A1 Jun. 16, 2011

(30) Foreign Application Priority Data

Dec. 11, 2009 (KR) ..... 10-2009-0123526

(51) Int. Cl.
*F04C 14/18* (2006.01)
*F04C 11/00* (2006.01)
*F01C 20/18* (2006.01)

(52) U.S. Cl.
USPC ..... 418/23; 418/22; 418/210; 418/215; 418/217

(58) Field of Classification Search
USPC ..... 418/15, 209, 210, 211, 215, 217, 219, 418/22–24, 26, 60, 63, 65, 11, 212; 417/440, 210, 213
See application file for complete search history.

(56) References Cited

U.S. PATENT DOCUMENTS

| | | | | |
|---|---|---|---|---|
| 5,829,960 | A * | 11/1998 | Dreiman | 418/63 |
| 8,056,361 | B2 * | 11/2011 | Matsui et al. | 418/60 |
| 2008/0107556 | A1 * | 5/2008 | Bae et al. | 418/63 |

FOREIGN PATENT DOCUMENTS

| | | | |
|---|---|---|---|
| CN | 1423056 | A | 6/2003 |
| CN | 101205918 | A | 6/2008 |
| CN | 201083198 | Y * | 7/2008 |
| CN | 201083198 | Y | 7/2008 |
| CN | 201092960 | Y | 7/2008 |
| JP | 9-112461 | | 5/1997 |
| JP | 2001-132674 | | 5/2001 |
| JP | 2005-030232 | | 2/2005 |
| WO | WO 2008026428 | A1 * | 3/2008 |

OTHER PUBLICATIONS

Chinese Office Action issued in CN Application No. 201010588835.5 dated Dec. 31, 2012 (full English translation and full Chinese text).

* cited by examiner

*Primary Examiner* — Mary A Davis
(74) *Attorney, Agent, or Firm* — KED & Associates, LLP

(57) ABSTRACT

A rotary compressor is provided. The rotary compressor may include a plurality of cylinders each having a suction port formed such that an intersection of a center line of the suction port and a center line of a vane slot is positioned at a predetermined interval closer to the vane slot than to an intersection between a center of an inner diameter of the cylinder and the center line of the vane slot. A proximal end of the suction port may be formed in the vicinity of the vane slot so as to advance a compression start angle of a compression space and reduce a dead volume between the vane slot and the suction port, thus improving compressor performance.

11 Claims, 7 Drawing Sheets

ROTARY COMPRESSOR WITH IMPROVED SUCTION PORTION LOCATION

CROSS-REFERENCE TO RELATED APPLICATION(S)

This application claims priority under 35 U.S.C. §119 to Korean Application No. 10-2009-0123526, filed in Korea on Dec. 11, 2009, whose entire disclosure is hereby incorporated by reference.

BACKGROUND

1. Field

This relates to a compressor, and in particular, to a rotary compressor capable of supplying refrigerant into a plurality of compression spaces using a single suction passage.

2. Background

In general, refrigerant compressors are used in refrigerators or air conditioners using a vapor compression refrigeration cycle (hereinafter, referred to as 'refrigeration cycle'). A constant speed type compressor may be driven at a substantially constant speed, while an inverter type compressor may be operated at selectively controlled rotational speeds.

A refrigerant compressor, in which a driving motor and a compression device operated by the driving motor are installed in an inner space of a hermetic casing, is called a hermetic compressor, and may be used in various home and/or commercial applications. A refrigerant compressor, in which the driving motor is separately installed outside the casing, is called an open compressor. Refrigerant compressors may be further classified into a reciprocal type, a scroll type, a rotary type and others based on a mechanism employed for compressing a refrigerant.

The rotary compressor may employ a rolling piston which is eccentrically rotated in a compression space of a cylinder, and a vane, which partitions the compression space of the cylinder into a suction chamber and a discharge chamber. Such a compressor may benefit from an enhanced capacity or a variable capacity.

BRIEF DESCRIPTION OF THE DRAWINGS

The embodiments will be described in detail with reference to the following drawings in which like reference numerals refer to like elements wherein.

DETAILED DESCRIPTION

A twin rotary compressor may include a plurality of cylinders that may be selectively operated to provide increased and/or variable capacity. Such a twin rotary compressor may employ an independent suction mechanism, in which suction pipes are respectively connected to the cylinders, or an integrated suction mechanism, in which a common suction pipe is connected to one of the two cylinders, or a common suction pipe is connected to a middle plate, which is disposed between the cylinders to partition the compression space.

Figure 1:
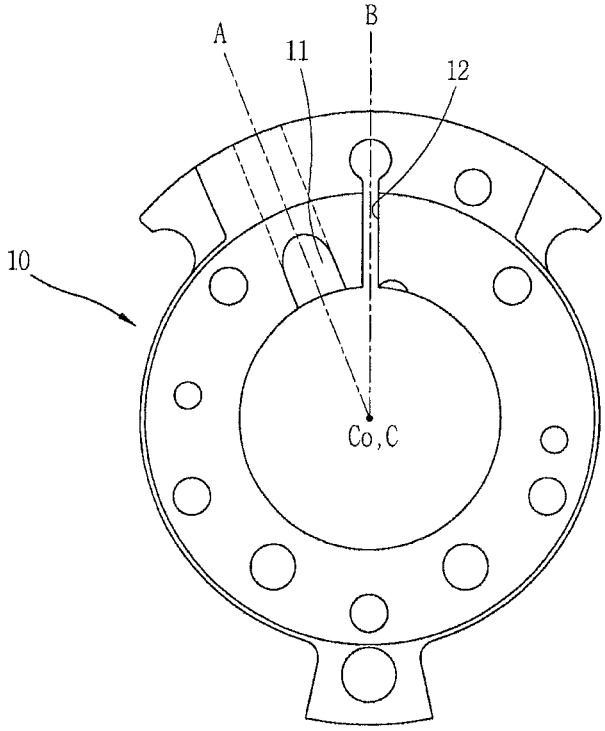
FIG. 1 is a plan view of an angle of a suction port formed in an exemplary rotary compressor.

In the exemplary twin rotary compressor shown in FIG. 1, a suction port 11 for guiding refrigerant into each compression space may be formed such that a center line A of the suction port 11 along a flow direction of the refrigerant, namely, in a lengthwise direction of the suction port 11, passes along a first intersection C where a center Co of an inner diameter of a cylinder 10 meets a center line B of a vane slot 12. A relatively large gap may be formed between the suction port 11 and the vane slot 12, increasing a dead volume between the suction port 11 and the vane slot 12 and also delaying a compression start angle, thereby degrading performance of the compressor.

Figure 2:
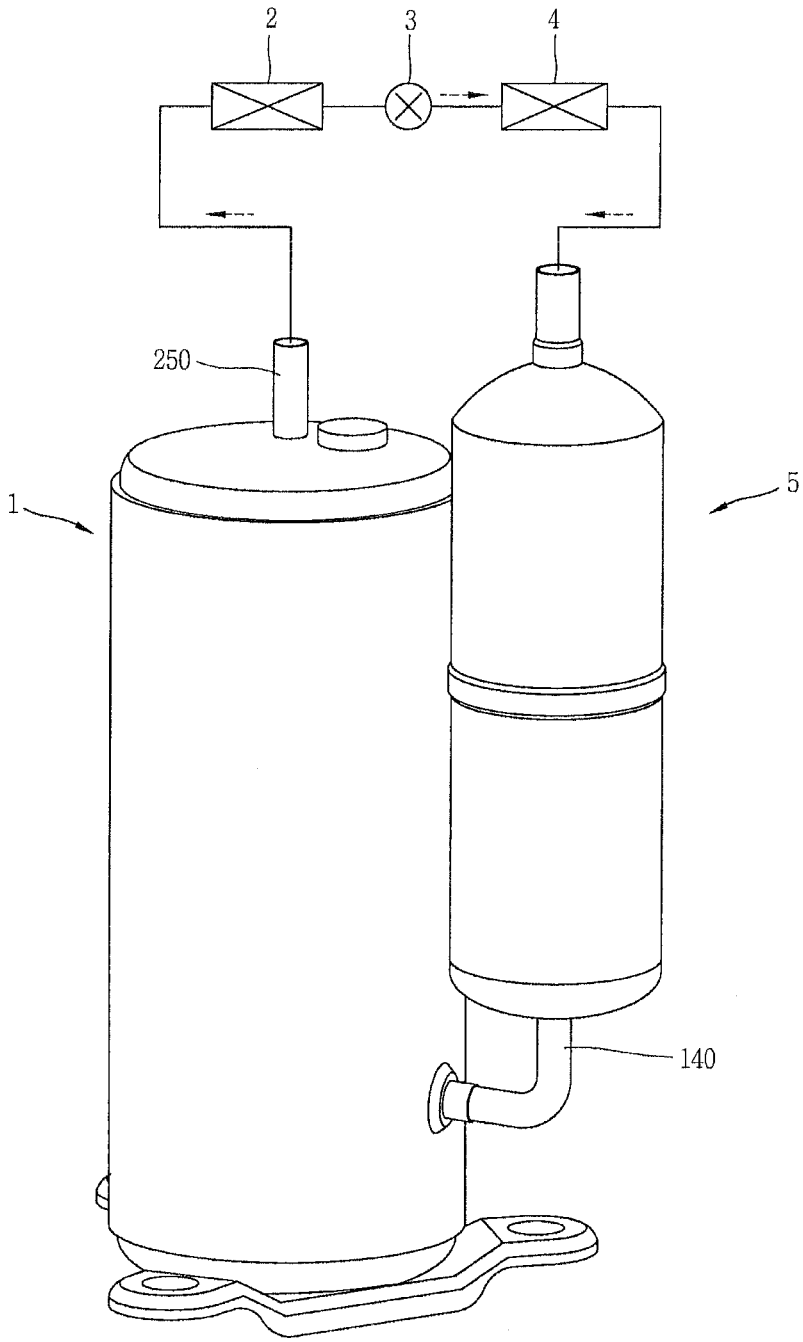
FIG. 2 is a schematic view of a refrigeration cycle including a rotary compressor in accordance an embodiment as broadly described herein.
Figure 3:
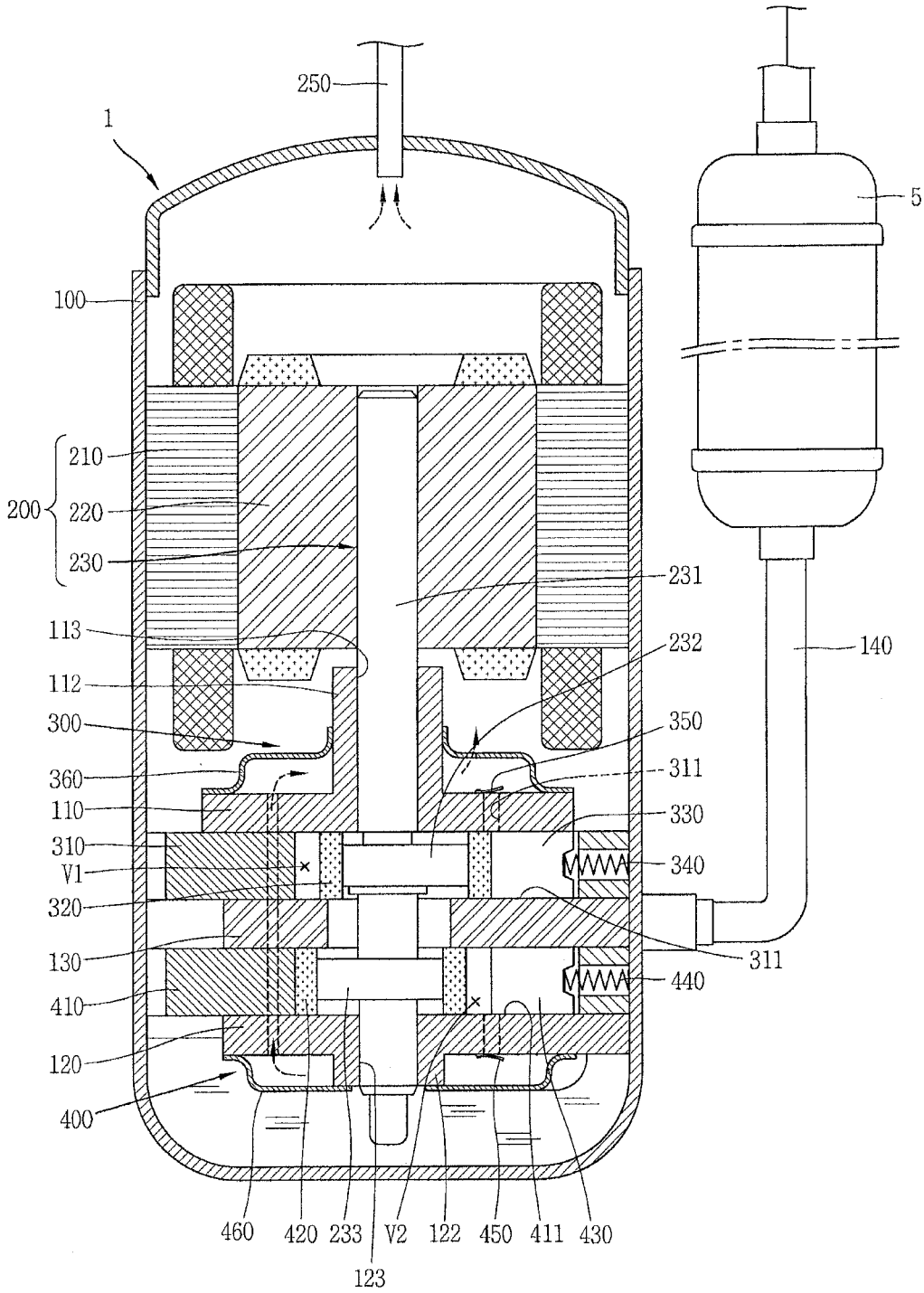
FIGS. 3 and 4 are longitudinal sectional views of an inside of the rotary compressor shown in FIG. 2.

As shown in FIG. 2, a rotary compressor 1 according to one exemplary embodiment may have a suction side thereof connected to an outlet side of an evaporator 4 and simultaneously have a discharge side thereof connected to a suction side of a condenser 2 so as to form a part of a closed loop refrigeration cycle which sequentially connects the condenser 2, an expansion apparatus 3 and the evaporator 4. An accumulator 5 is positioned between the outlet side of the evaporator 4 and the suction side of the compressor 1 to separate refrigerant from the evaporator 4 into gas refrigerant and liquid refrigerant.

The compressor 1 may include a motor 200 provided at an upper portion of an inner space of a hermetic casing 100 to generate a driving force, and first and second compression devices 300 and 400 provided at a lower portion of the inner space of the casing 100 to compress a refrigerant using the driving force generated by the motor 200.

The inner space of the casing 100 is maintained in a discharge pressure state by a refrigerant discharged from both the first and second compression devices 300 and 400 or from the first compression device 300. A gas suction pipe 140 that allows refrigerant to be drawn in between the first and second compression devices 300 and 400 may be connected to a lower portion of the casing 100, and a gas discharge pipe 250 that allows compressed refrigerant to be discharged into a refrigeration system may be connected to an upper end of the casing 100. The gas suction pipe 140 may be inserted in a middle connection pipe (not shown), which is inserted in a communication passage 131 of a middle plate 130, and in certain embodiments, may be welded to the middle connection pipe.

The motor 200 may include a stator 210 secured to an inner circumferential surface of the casing 100, a rotor 220 rotatably disposed within the stator 210, and a crank shaft 230 shrink-fitted to the rotor 220 so as to be rotatable with the rotor 220. The motor 200 may be a constant speed motor, an inverter motor, or other type of motor as appropriate. In consideration of the fabricating cost, the motor 200 may be a constant speed motor so as to idle one of the first or second compression devices 300 and 400, when necessary, so as to switch an operational mode of the compressor.

The crank shaft 230 may include a shaft portion 231 coupled to the rotor 220, and first and second eccentric portions 232 and 233 formed at a lower portion of the shaft portion 231 so as to be eccentric to both right and left sides of the shaft portion 231. The first and second eccentric portions 232 and 233 may be symmetrically formed by a phase difference of about 180° therebetween. First and second rolling pistons 320 and 420, which will be described later, may be rotatably coupled to the first and second eccentric portions 232 and 233, respectively.

The first compression device 300 may include a first cylinder 310 having an annular shape and installed within the casing 100, the first rolling piston 320 rotatably coupled to the first eccentric portion 232 of the crank shaft 230 to compress a refrigerant as it orbits in a first compression space V1 of the first cylinder 310, a first vane 330 movably coupled to the first cylinder 310 in a radial direction such that a sealing surface of one end thereof contacts an outer circumferential surface of the first rolling piston 320 so as to partition the first compression space V1 of the first cylinder 310 into a first suction chamber and a first discharge chamber, and a vane spring 340 implemented as, for example, a compression spring so as to elastically support a rear end of the first vane 330.

The second compression device 400 may include a second cylinder 410 having an annular shape and installed below the first cylinder 310 within the casing 100, the second rolling piston 420 rotatably coupled to the second eccentric portion 233 of the crank shaft 230 to compress a refrigerant as it orbits in a second compression chamber V2 of the second cylinder 410, a second vane 430 movably coupled to the second cylinder 410 in a radial direction and contacting an outer circumferential surface of the second rolling piston 420 so as to partition the second compression space V2 of the second cylinder 410 into a second suction chamber and a second discharge chamber or separated from the outer circumferential surface of the second rolling piston 420 to provide for communication between the second suction chamber and the second discharge chamber, and a vane spring 440 implemented as, for example, a compression spring to elastically support a rear end of the second vane 430.

Referring to FIG. 2, the first cylinder 310 and the second cylinder 410 may respectively include a first vane slot 311 and a second vane slot 411 formed at respective inner circumferential surfaces of the first and second compression spaces V1 and V2 to allow a linear reciprocation of the first and second vanes 330 and 430, and a first suction port 312 and a second suction port 412 formed at respective sides of the first and second vane slots 311 and 411 to induce a refrigerant into the first and second compression spaces V1 and V2.

The first suction port 312 and the second suction port 412 may be formed with an inclination angle by chamfering a lower surface edge of the first cylinder 310 and an upper surface edge of the second cylinder 410, respectively, which come in contact with upper and lower ends of divergent holes 133 and 134 of a middle plate 130 to be explained later (see FIG. 8), respectively, so as to be inclined toward the first cylinder 310 and the second cylinder 410.

An upper bearing plate (hereinafter, referred to as 'upper bearing') 110 may cover a top of the first cylinder 310, and a lower bearing plate (hereinafter, referred to as 'lower bearing') 120 may cover a lower side of the second cylinder 410. The middle plate 130, which forms the first and second compression spaces V1 and V2 together with the both bearings 110 and 120, may be installed between a lower side of the first cylinder 310 and an upper side of the second cylinder 410.

The upper bearing 110 and the lower bearing 120 may have a disc-like shape. A first bearing portion 112 and a second bearing portion 122 having shaft holes 113 and 123, respectively, may protrude from centers of the upper bearing 110 and the lower bearing 120 so as to support the shaft portion 231 of the crank shaft 230 in a radial direction.

Figure 4:
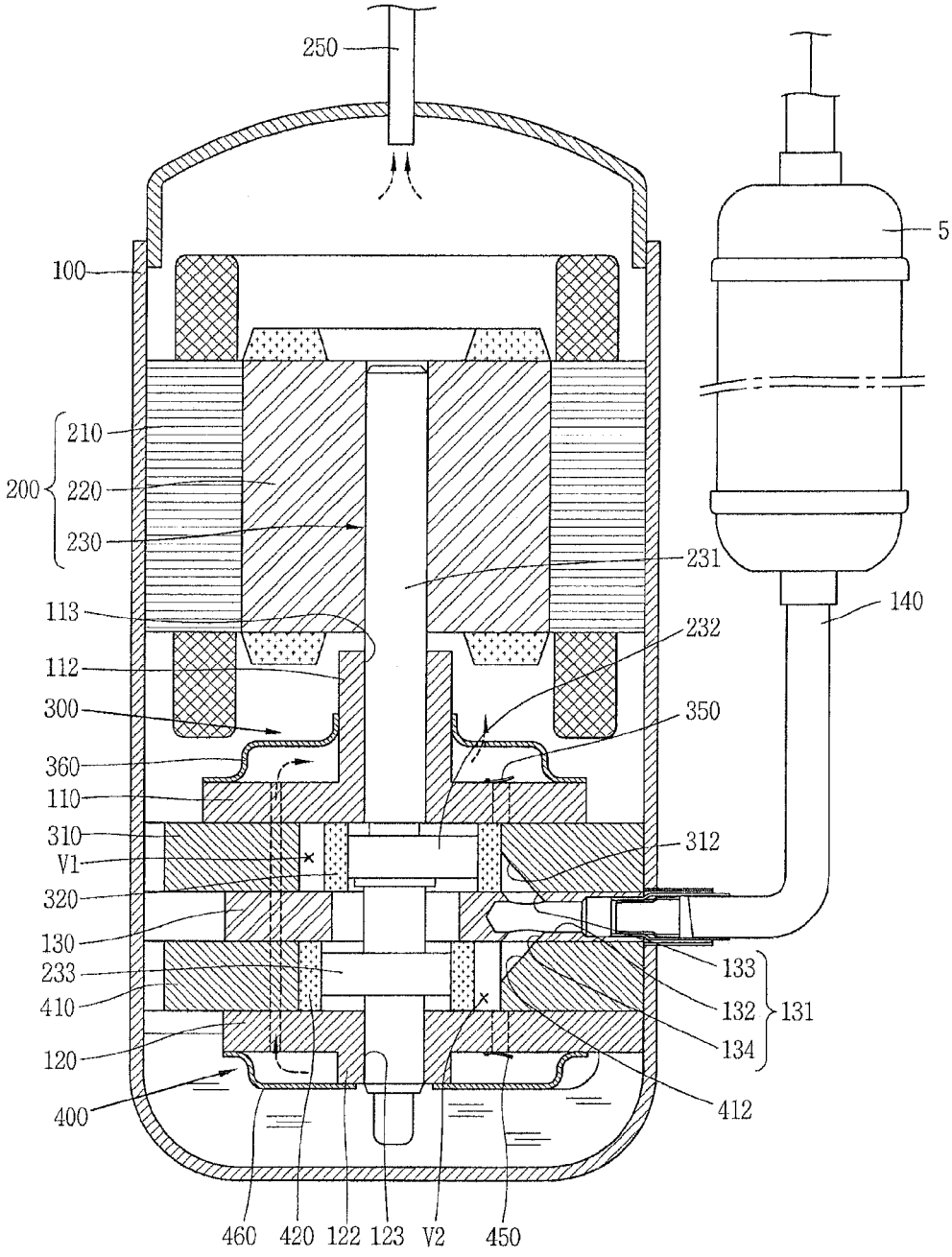

The middle plate 130 may have an annular shape with an inner diameter as wide as the eccentric portions 232 and 233 of the crank shaft 230 being inserted therethrough. One side of the middle plate 130 has the suction passage 131 formed therein for allowing the gas suction pipe 140 to communicate with the first suction port 312 and the second suction port 412 (see FIG. 4). The suction passage 131 may include a suction hole 132 communicating with the gas suction pipe 140, and the first and second divergent holes 133 and 134 for allowing the first and second suction ports 312 and 412 to communicate with the suction hole 132.

The suction hole 132 may have a predetermined depth from the outer circumferential surface of the middle plate 130 in a radial direction.

The first and second divergent holes 133 and 134 may be inclined by a predetermined angle, for example, an angle in the range of 0° to 90° based upon a center line of the suction hole 132. In certain embodiments, an angle in the range of 30° to 60°, from an inner end of the suction hole 132 toward the first and second suction ports 312 and 412, may be appropriate.

A first discharge valve 350, a first muffler 360, a second discharge valve 450 and a second muffler 460 may also be provided with the compressor 1.

Hereinafter, a description of a process of compressing a refrigerant in each compression space of a rotary compressor as embodied and broadly described herein will be provided.

If power is supplied to the motor 200 to rotate the rotor 220, the crank shaft 230 rotates together with the rotor 220 to transfer a rotating force of the motor 200 to the first and second compression devices 300 and 400. The first and second rolling pistons 320 and 420 within the first compression device 300 and the second compression device 400 eccentrically rotate in the first compression space V1 and the second compression space V2, respectively. The first vane 330 and the second vane 430 thus compress a refrigerant while forming the compression spaces V1 and V2, having a phase difference of approximately 180° therebetween, together with the first and second rolling pistons 320 and 420.

For example, if a suction process is initiated in the first compression space V1, refrigerant is introduced into the suction passage 131 of the middle plate 130 via the accumulator 5 and the suction pipe 140. The refrigerant then flows into the first compression space V1 via the first suction port 312 of the first cylinder 310 so as to be compressed therein.

During a compression process in the first compression space V1, a suction process is initiated in the second compression space V2 of the second cylinder 410 having a phase difference of approximately 180° from the first compression space V1. Accordingly, the second suction port 412 of the second cylinder 410 communicates with the suction passage 131, so that refrigerant is drawn into the second compression space V2 via the second suction port 412 of the second cylinder 410 so as to be compressed therein.

The first suction port 312 and the second suction port 412 may have a compression start angle in each compression space V1 and V2 that varies depending on a position at which they are formed, or an angle at which they are formed, so as to impact a refrigeration function of the compressor accordingly.

For instance, if the first suction port 312 (the second suction port 412 being substantially the same as the first suction port 312 in shape and position, and thus also understood by this description) is formed relatively far away from the first vane slot 311, the compression start angle may be delayed by a commensurate amount and simultaneously the dead volume may be increased, thereby lowering compressor efficiency. On the contrary, if the first suction port 312 is formed in the vicinity of the first vane slot 311, the compression start angle may be advanced by a commensurate amount and simultaneously the dead volume may be decreased, thus improving compressor efficiency.

However, if the first suction port 312 is formed too close to the first vane slot 311, the interval (gap, distance) between the first suction part 312 and the first vane slot 311 may be overly narrow, which may cause the cylinder, between the first vane slot 311 and the first suction port 312, to be relatively weak and lack rigidity. Accordingly, when coupling the first cylinder 310 and the upper bearing 110 to the middle plate 130 by using bolts, the clamping force of the bolts may deform the first cylinder 310. Consequently, the slot shape of the vane slot 311 may not be maintained, thereby increasing friction loss and/or increasing leakage loss of refrigerant due to generation of a gap (clearance) between the first rolling piston 320 and the first vane 330. Therefore, to minimize the dead volume between the first vane slot 311 and the first suction port 312, the first suction port 312 may be formed in the vicinity of the first vane slot 311 if possible. However, in order to ensure sufficient rigidity to avoid deformation of the first vane slot 311, a uniform interval may be maintained between the first vane slot 311 and the first suction port 312. In consideration of this, an appropriate position at which to form the first suction port 312 may be determined.

Figure 5:
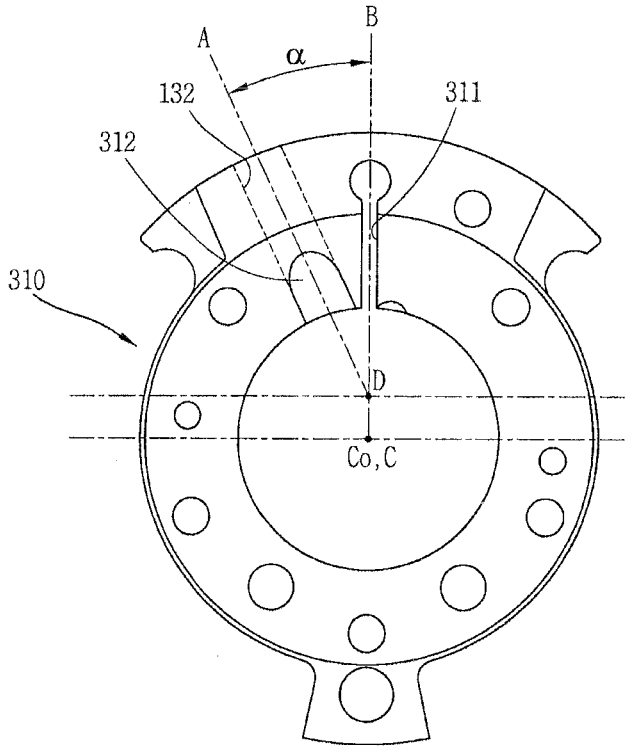
FIG. 5 is a plan view of angles of first and second suction ports formed in the rotary compressor shown in FIG. 4.
Figure 6:
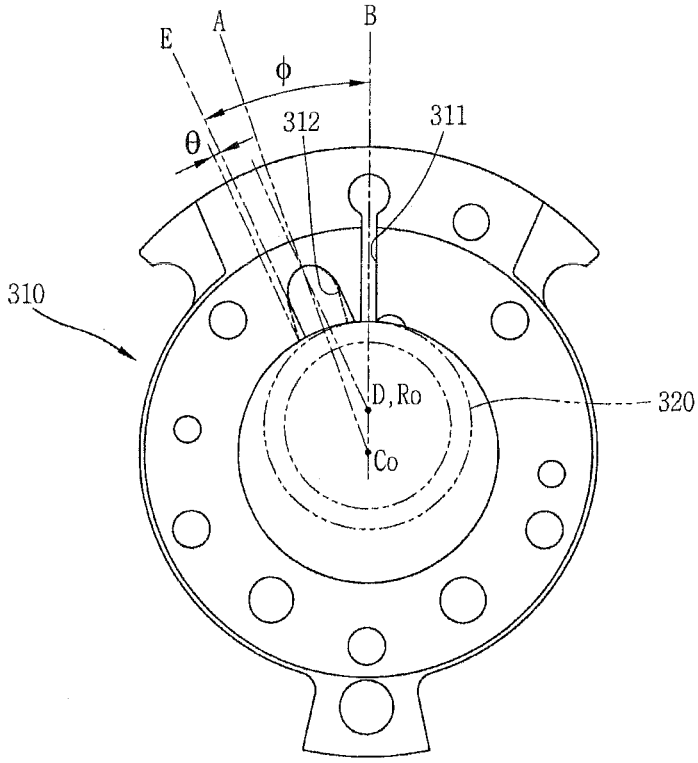
FIG. 6 is a plan view comparing the suction port of the rotary compressor shown in FIG. 5 with the suction port of the rotary compressor shown in FIG. 1.
Figure 7:
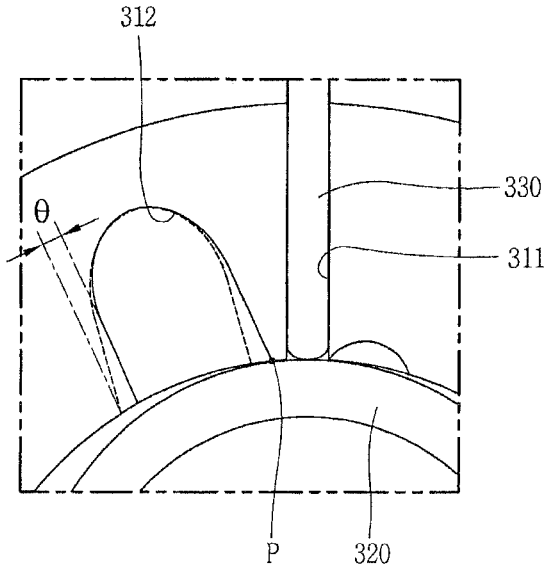
FIG. 7 is an enlarged view of the first suction port of the rotary compressor shown in FIG. 6.

As shown in FIGS. 5 and 6, the first suction port 312 may have an intersection D where a center line A of the first suction port 312 in a flow direction of the refrigerant, namely, in a lengthwise direction, meets a center line B of the first vane slot 311 in the lengthwise direction. The intersection D is a predetermined distance closer to the first vane slot 311 than to the intersection C between a center Co of an inner diameter of the first cylinder 310 and the center line B.

That is, the first suction port 312 may be formed such that the center line A passes along a center Ro of the first rolling piston 320 at a position where a tangent line passing along an outer circumferential surface of the first rolling piston 320 is orthogonal to the center line B of the first vane slot 311. Accordingly, the interval (or distance) between the first vane slot 311 and the first suction port 312 may be maintained to some degree, thereby obviating deformation of the first vane slot 311. Furthermore, an inner circumferential surface interval between the first vane slot 311 and the first suction port 312 may be reduced, thereby advancing the compression start angle by a value θ when compared to the arrangement shown in FIG. 1, where the center line A of the first suction port 312 intersects the center Co of the cylinder, as well as decreasing the dead volume, resulting in improved compressor performance.

An angle of circumference ϕ may be formed between the first suction port 312 and the first vane slot 311, and in particular, based upon a rotating direction of the first rolling piston 320, and a center line E, which connects an end of the first suction port 312 and the center Co of the cylinder, with the center line B passing through the first vane slot 311 may be in the range of $10° < \phi < 45°$ so as to reduce the dead volume between the first vane slot 311. The angle of circumference ϕ and the first suction port 312 and also reduce the compression start angle. Even if the center line A of the first suction port 312 passes through the center Ro of the second rolling piston 320 at the moment when an outer circumferential surface of the second rolling piston 320 contacts the first vane slot 311, if the angle of circumference ϕ exceeds this range, an actual angle of circumference ϕ between the first suction port 312 and the first vane slot 311 may become relatively wide, and the dead volume may increased when compared to the arrangement shown in FIG. 1, and also the compression start angle may be further delayed, resulting in lowering compression efficiency.

Equation 1 for measuring a volume increase in accordance with this exemplary embodiment is as follows.

$$V = \frac{\Pi}{4} \times (D^2 - Dr^2) \times H \times \left(1 - \frac{\phi^\circ}{360}\right) \quad \text{Equation 1}$$

In equation 1, V denotes a volume increase (in, for example, cc), D denotes an inner diameter of a cylinder, H denotes a height of a cylinder, Dr denotes an outer diameter of a rolling piston and ϕ denotes an angle of circumference. By comparing actual volume increases using Equation 1, the refrigeration function of the compressor may be improved due to an increase in the volume of the compression space.

In addition, if the first suction port 312 is formed closer to the first vane slot 311, the interval (distance) between the first suction port 312 and the first vane slot 311 may become more narrow. Accordingly, a distance that the first rolling piston 320 slides in order to reach a start end of the first suction port 312 via the first vane slot 311 may be shortened. Therefore, the dead volume generated between the first vane slot 311 and the first suction port 312 may be decreased so as to minimize (or prevent) an increase in a specific volume of a refrigerant introduced through the first suction port 312, thereby improving the refrigeration function and performance of the compressor.

On the contrary, if the angle of circumference ϕ is less than a value within the given range, the actual angle of circumference D between the first suction port 312 and the first vane slot 311 may become excessively narrow compared to the arrangement shown in FIG. 1. Consequently, the distance between the first vane slot 311 and the first suction port 312 becomes narrow, which lowers rigidity accordingly. As a result, deformation of the first vane slot 311 may occur, increasing friction loss of the first vane 330, and/or a gap (clearance) may be generated between the first vane 330 and the first rolling piston 320, increasing leakage of refrigerant.

As proximal ends of the first and second suction ports 312 and 412 are formed closer to the first and second vane slots 311 and 411, the compression start angles of the first and second compression spaces V1 and V2 may be advanced. Also, as the dead volume between each vane slot and each suction port may be decreased, the refrigeration function, efficiency and performance of the compressor may be improved.

Although a twin rotary compressor is discussed herein for exemplary purposes, such an arrangement may be equally applicable to a single rotary compressor.

Figure 8:
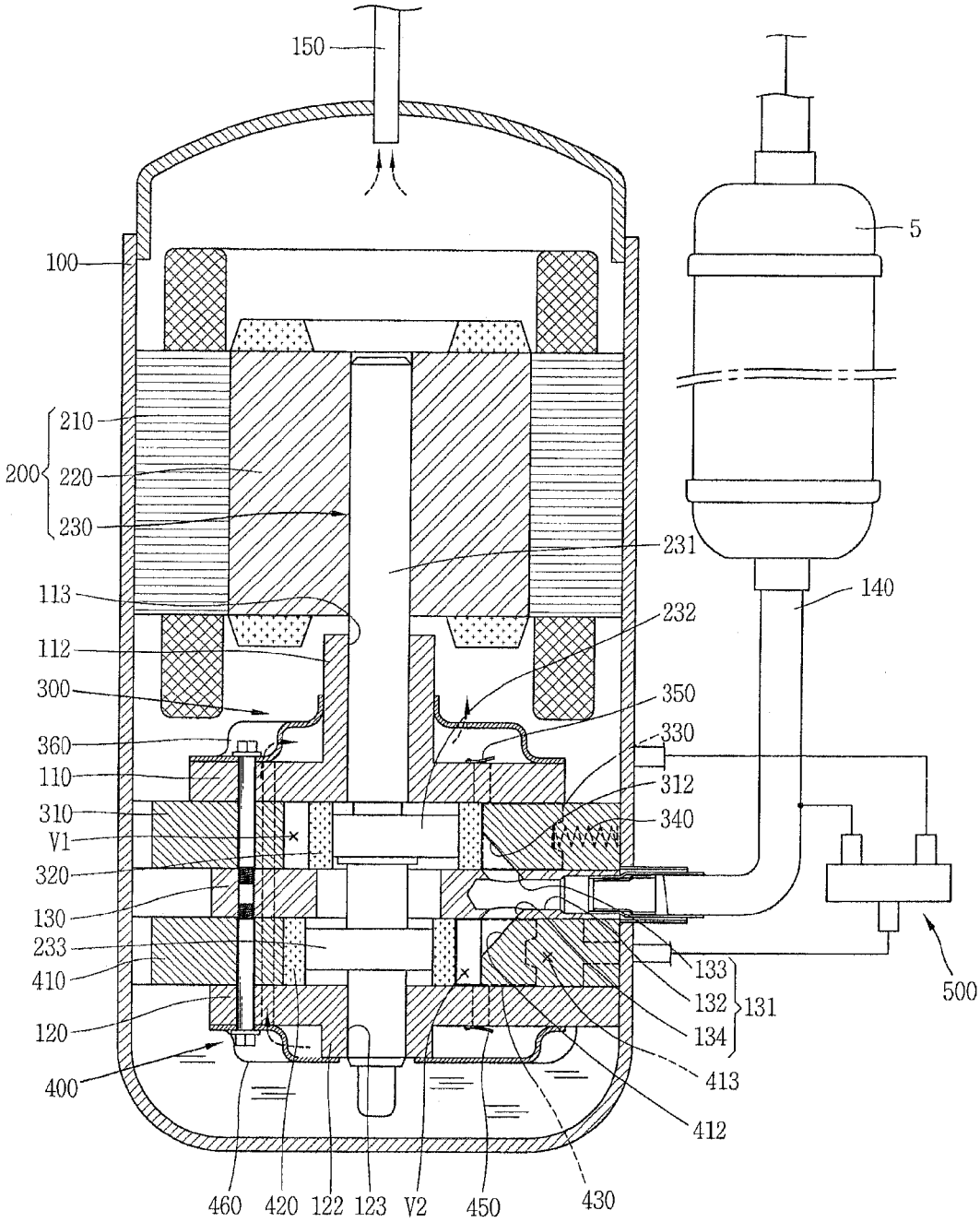
FIG. 8 is a longitudinal section view of a capacity-variable type rotary compressor in accordance with embodiments broadly described herein.

As shown in FIG. 8, this arrangement may also be applicable to a capacity-variable type rotary compressor. A vane chamber 413 that is isolated from the inner space of the casing 100 may be formed at a rear end of a vane 430 of a compression device (i.e., the second compression device 400). A mode switching device 500 for selectively supplying suction pressure or discharge pressure may be connected to the vane chamber 413, and a restricting device for selectively restricting the movement of the vane 430 may also be provided.

A rotary compressor as embodied and broadly described herein may be widely applicable to refrigeration systems, such as home or commercial air conditioners, and other systems as appropriate.

A rotary compressor is provided that is capable of improving compressor function by reducing a dead volume between a suction port and a vane slot and advancing a compression start angle so as to improve the compressor function.

A rotary compressor as embodied and broadly described herein may include a rolling piston and a vane disposed in a compression space of each cylinder, wherein the cylinder is provided with a vane slot for allowing sliding of the vane and a suction port for sucking a refrigerant into the compression space of the cylinder is provided at one side of the vane slot, wherein the suction port is formed to have an intersection in the compression space between a center line in a direction of the refrigerant being introduced and a center line of the vane slot in a lengthwise direction thereof, and the intersection is closer to the vane slot than to the center of the compression space.

A rotary compressor as embodied and broadly described herein may include a plurality of cylinders each having a compression space for compressing a refrigerant, the compression space having a rolling piston and a vane therein, a vane slot having the vane slidably inserted therein, and a suction port formed at one side of the vane slot for guiding the refrigerant into the compression space, a middle plate installed between the cylinders to partition each compression space, and having one suction passage for allowing a refrigerant to be distributed into the suction ports of the cylinders, and a plurality of bearings each configured to cover an outer surface of each cylinder to form a compression space in each cylinder together with the middle plate, wherein each of the suction ports is formed to have a second intersection D where a center line A in a direction of the refrigerant being introduced meets a center line B of the vane slot in the lengthwise direction at a position with a predetermined distance closer to the vane slot than to the intersection C between a center Co of an inner diameter of the cylinder and the center line B.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a plurality of cylinders each having a compression space formed therein, a suction port that communicates with each compression space, and a vane slot formed at a predetermined interval from the suction port in a circumferential direction;

a plurality of rolling pistons that respectively orbit in the compression spaces of the plurality of cylinders so as to compress refrigerant therein; and a plurality of vanes each slidably inserted in a respective vane slot so as to partition the corresponding compression space into a suction chamber and a discharge chamber, wherein a center line of the suction port that extends in a refrigerant flow direction intersects, in the compression space, with a center line of the vane slot extending in a longitudinal direction thereof, wherein the intersection point is closer to the vane slot than to a center of the compression space, wherein the center line of the suction port passes along a center of the rolling piston at a position where a tangent line passing along an outer circumferential surface of the rolling piston is orthogonal to the center line of the vane slot.

2. The rotary compressor of claim 1, wherein the suction port is formed such that an angle of circumference Φ between a center line, which connects an end of the suction port and the center of the compression space, and the center line passing through the vane slot is in the range of $10° < \Phi < 45°$, based upon a rotating direction of the rolling piston.

3. The rotary compressor of claim 1, wherein the suction port is formed such that an angle of circumference Φ between a center line, which connects an end of the suction port and the center of the compression space, and the center line passing through the vane slot is in the range of $10° < \Phi < 45°$, based upon a rotating direction of the rolling piston.

4. The rotary compressor of claim 1, wherein at least one of the plurality of cylinders comprises a vane chamber isolated from an inner space of a casing, wherein a mode switching device is connected to the vane chamber so as to selectively supply discharge pressure or suction pressure to the vane chamber based on an operational mode of the compressor such that the vane selectively contacts the rolling piston, wherein at least one of the plurality of cylinders comprises a vane restricting device that selectively restricts movement of the vane slidably coupled to the cylinder.

5. The rotary compressor of claim 4, wherein the vane restricting device generates a pressure difference at a side surface of the vane to selectively restrict movement of the vane.

6. A rotary compressor, comprising:

a plurality of cylinders each having a compression space formed therein, with a rolling piston and a vane provided in the compression space, a vane slot having the vane slidably inserted therein, and a suction port formed at one side of the vane slot so as to guide refrigerant into the compression space;

a middle plate installed between adjacent cylinders of the plurality of cylinders, the middle plate having a suction passage fondled therein that distributes refrigerant into the suction ports of the plurality of cylinders; and a plurality of bearings that respectively cover an outer surface of the plurality of cylinders so as to define the compression space in each cylinder together with the middle plate, wherein each of the suction ports is formed such that an intersection D where a center line A extending in a refrigerant flow direction meets a center line B of the vane slot in the lengthwise direction is positioned a predetermined distance closer to the vane slot than to an intersection C between a center of an inner diameter of the cylinder and the center line B, wherein each of the suction ports is formed such that the center line A passes through a center of the rolling piston at a position where a tangent line passing along an outer circumferential surface of the rolling piston is orthogonal to the center line B of the vane slot.

7. The rotary compressor of claim 6, wherein each of the suction ports is formed such that an angle of circumference Φ between a line E, which connects an end of the suction port and a center of the compression space, and the center line B passing through the vane slot is in the range of $10° < \Phi < 45°$, based upon a totaling direction of the rolling piston.

8. The rotary compressor of claim 6, wherein each of the suction ports is formed such that an angle of circumference Φ between a line E, which connects an end of the suction port and a center of the compression space, and the center line B passing through the vane slot is in the range of $10° < \Phi < 45°$, based upon a rotating direction of the rolling piston.

9. The rotary compressor of claim 6, wherein the suction passage is formed such that a center line thereof in a lengthwise direction matches the center line of the suction port A in an axial direction.

10. The rotary compressor of claim 9, wherein the suction passage comprises:

a suction hole formed in a radial direction so as to communicate with a gas suction pipe; and a plurality of divergent holes that each diverge from an end of the suction hole and extend toward a respective cylinder of the plurality of cylinders so as to respectively communicate with the suction ports, wherein each of the plurality of divergent holes is inclined with respect to a center line of the suction hole.

11. The rotary compressor of claim 6, wherein at least one of the plurality of cylinders comprises a vane chamber isolated from an inner space of a casing, wherein a mode switching device is connected to the vane chamber so as to selectively supply discharge pressure or suction pressure to the vane chamber based on an operational mode of the compressor such that the vane selectively contacts the rolling piston, and wherein at least one of the plurality of cylinders comprises a vane restricting device that selectively restricts movement of the vane slidably coupled to the cylinder.

* * * * *